US010392585B2

(12) United States Patent
Backer et al.

(10) Patent No.: US 10,392,585 B2
(45) **Date of Patent: *Aug. 27, 2019**

(54) AUTOMATIC DISHWASHING DETERGENT

(71) Applicant: Rohm and Haas Company, Collegeville, PA (US)

(72) Inventors: Scott Backer, Phoenixville, PA (US); Severine Ferrieux, Grasse (FR); Paul Mercando, Pennsburg, PA (US)

(73) Assignee: Rohm and Haas Company, Philadelphia, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/542,531

(22) PCT Filed: Feb. 22, 2016

(86) PCT No.: PCT/US2016/018935

§ 371 (c)(1),
(2) Date: Jul. 10, 2017

(87) PCT Pub. No.: WO2016/153668

PCT Pub. Date: Sep. 29, 2016

(65) Prior Publication Data

US 2018/0265814 A1 Sep. 20, 2018

(30) Foreign Application Priority Data

Mar. 20, 2015 (EP) ..... 15290079

(51) Int. Cl.

| | |
|---|---|
| ***C11D 1/00*** | (2006.01) |
| ***C11D 3/08*** | (2006.01) |
| ***C11D 3/30*** | (2006.01) |
| ***C11D 3/37*** | (2006.01) |
| ***C11D 1/66*** | (2006.01) |
| ***C11D 3/20*** | (2006.01) |
| ***C11D 3/33*** | (2006.01) |

(52) U.S. Cl.

CPC ..... *C11D 3/3757* (2013.01); *C11D 1/00* (2013.01); *C11D 1/66* (2013.01); *C11D 3/08* (2013.01); *C11D 3/2075* (2013.01); *C11D 3/33* (2013.01); *C11D 3/378* (2013.01); *C11D 3/3761* (2013.01); *C11D 3/3765* (2013.01); *C11D 3/3769* (2013.01)

(58) Field of Classification Search

CPC .... C11D 1/00; C11D 1/66; C11D 3/08; C11D 3/2075; C11D 3/33; C11D 3/3757; C11D 3/3761; C11D 3/3765; C11D 3/378

USPC ..... 510/221, 223, 227, 230, 232, 475, 477, 510/480, 488, 499, 505

See application file for complete search history.

(56) References Cited

U.S. PATENT DOCUMENTS

| | | | | |
|---|---|---|---|---|
| 6,221,834 | B1 | 4/2001 | Yamamoto et al. | |
| 8,101,027 | B2 | 1/2012 | Vandermeulen et al. | |
| 8,262,804 | B2 | 9/2012 | Weber et al. | |
| 9,677,033 | B2 * | 6/2017 | Krasnansky | C11D 1/72 |
| 2008/0188391 | A1 * | 8/2008 | Seebeck | C11D 3/33 510/228 |
| 2010/0234264 | A1 | 9/2010 | Creamer et al. | |
| 2011/0224118 | A1 * | 9/2011 | Creamer | C11D 3/33 510/230 |
| 2012/0129750 | A1 * | 5/2012 | Detering | C11D 3/378 510/228 |
| 2012/0196784 | A1 | 8/2012 | Seebeck et al. | |
| 2013/0150277 | A1 * | 6/2013 | Fischer | C11D 3/3788 510/230 |
| 2016/0177232 | A1 * | 6/2016 | Souter | C11D 1/29 435/264 |
| 2016/0177237 | A1 * | 6/2016 | Souter | C11D 1/12 510/226 |
| 2016/0355756 | A1 * | 12/2016 | Krasnansky | C11D 1/72 |

FOREIGN PATENT DOCUMENTS

| | | |
|---|---|---|
| JP | 4015850 | 1/1992 |
| JP | 2003193098 | 7/2003 |
| JP | 2004204055 | 7/2004 |
| JP | 2008127490 | 6/2008 |

OTHER PUBLICATIONS

Office Action from corresponding Japanese 2017-563500 application, dated May 24, 2018.

* cited by examiner

*Primary Examiner* — Gregory R Delcotto

(57) ABSTRACT

Provided is a detergent composition and method for reducing filming and spotting in automatic dishwashing systems. The composition comprises: aspartic acid diacetic acid or salt thereof; a dispersant polymer comprising a (meth) acrylic polymer with a Mw from 2000 to 100,000; a builder; and a surfactant.

8 Claims, No Drawings

AUTOMATIC DISHWASHING DETERGENT

CROSS-REFERENCE TO RELATED APPLICATION

This application claims priority to European Patent Application No. 15290079.1, filed Mar. 20, 2015.

FIELD

This invention relates generally to detergent compositions that exhibit reduced filming and/or spotting in automatic dishwashing systems, as well as reduced corrosion of metal surfaces.

BACKGROUND

Automatic dishwashing detergents are generally recognized as a class of detergent compositions distinct from those used for fabric washing or water treatment. Automatic dishwashing detergents are expected by users to produce a spotless and film-free appearance on washed items after a complete cleaning cycle.

Phosphate-free compositions rely on non-phosphate builders, such as salts of citrate, carbonate, silicate, disilicate, bicarbonate, aminocarboxylates and others to sequester calcium and magnesium from hard water and block them from leaving an insoluble visible deposit on the dishware following drying.

The most commonly used aminocarboxylate builder in today's phosphate-free automatic dishwashing detergents is methylglycinediacetic acid (MGDA). Among the negatives of MGDA is that formulations containing this material are corrosive to glass and metal, and can often lead to pitting or discoloration on silverware and/or the metal components of a dishwasher.

Glutamic acid-N,N-diacetic acid (GLDA) is another aminocarboxylate builder that is used in phosphate-free automatic dishwashing detergents. GLDA also exhibits various shortcomings, including providing cleaning performance, such as spotless and film-free appearance on washed items, that is less than optimal.

Compositions that exhibit improved properties in automatic dishwashing would be an advance in the industry.

STATEMENT OF INVENTION

We have now found that compositions as described herein, containing aspartic acid diacetic acid (ASDA) or a salt thereof as an aminocarboxylate builder, exhibit favorable cleaning properties. Such compositions, for instance, show excellent filming and spotting performance as well as lack of corrosion on metal surfaces. In contrast, compositions containing MGDA or GLDA, but no ASDA, exhibit either poor cleaning or filming performance, increased corrosion of metal surfaces, or combinations of such shortcomings.

Accordingly, in one aspect, there is provided an automatic dishwashing detergent composition. The composition comprises: aspartic acid diacetic acid or salt thereof; a dispersant polymer comprising a (meth)acrylic polymer with a Mw from 2000 to 100,000; a builder; and a surfactant.

In another aspect, there is provided a method of cleaning an article in an automatic dishwashing machine. The method comprises: applying to the article a composition as described herein.

DETAILED DESCRIPTION

Unless otherwise indicated, numeric ranges, for instance as in "from 2 to 10," are inclusive of the numbers defining the range (e.g., 2 and 10). Unless otherwise indicated, ratios, percentages, parts, and the like are by weight. As used herein, unless otherwise indicated, the terms "molecular weight" and "Mw" are used interchangeably to refer to the weight average molecular weight as measured in a conventional manner with gel permeation chromatography (GPC) and polyacrylic acid standards. GPC techniques are discussed in detail in Modem Size Exclusion Chromatography, W. W. Yau, J. J. Kirkland, D. D. Bly; Wiley-Interscience, 1979, and in A Guide to Materials Characterization and Chemical Analysis, J. P. Sibilia; VCH, 1988, p. 81-84. Molecular weights are reported herein in units of Daltons. The term "ethylenically unsaturated" is used to describe a molecule or moiety having one or more carbon-carbon double bonds, which renders it polymerizable. The term "ethylenically unsaturated" includes monoethylenically unsaturated (having one carbon-carbon double bond) and multi-ethylenically unsaturated (having two or more carbon-carbon double bonds). As used herein the term "(meth) acrylic" refers to acrylic or methacrylic. Weight percentages (or wt %) in the composition are percentages of dry weight, i.e., excluding any water that may be present in the composition. Percentages of monomer units in the polymer are percentages of solids weight, i.e., excluding any water present in a polymer emulsion.

As indicated above, in one aspect, the invention provides an automatic dishwashing detergent composition. The composition comprises: aspartic acid diacetic acid or salt thereof; a dispersant polymer comprising a (meth)acrylic polymer with a Mw from 2000 to 100,000; a builder; and a surfactant.

Aspartic acid diacetic acid or ASDA refers to a molecule represented by the following chemical structure:

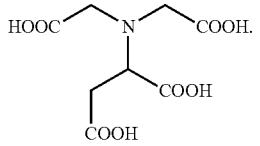

ASDA encompasses the D enantiomer, the L enantiomer, as well as racemic mixtures. In some embodiments, the L enantiomer is preferred. The invention also encompasses the mono, di-, tri-, and tetra-salts of ASDA, such as the mono, di-, tri-, and tetra-sodium or potassium salts. In some embodiments, the tetrasodium salt of ASDA is preferred:

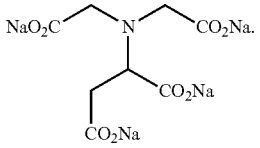

In some embodiments, the composition of the invention contains at least 10 weight percent, alternatively at least 15 weight percent of the aspartic acid diacetic acid or salt thereof, based on the total weight of composition. In some embodiments, the composition contains up to 40 weight percent, alternatively up to 30 weight percent of the aspartic acid diacetic acid or salt thereof, based on the total weight of the composition.

Optionally, the composition of the invention contains a water soluble silicate. Suitable water soluble silicates preferably have a water solubility of at least 10 g/100 mL at 25° C., more preferably at least 15 g/100 mL at 25° C. Exemplary water soluble silicates include alkali metal silicates, preferably sodium silicate, sodium disilicate, sodium metasilicate, or mixtures thereof.

In some embodiments, the composition of the invention, when a water soluble silicate is present, contains at least 0.1 weight percent, alternatively at least 1 weight percent, alternatively at least 3 weight percent, or alternatively at least 5 weight percent of the water soluble silicate, based on the total weight of the composition. In some embodiments, the amount of water soluble silicate, when present, is up to 10 weight percent, alternatively up to 8 weight percent, alternatively up to 7 weight percent, alternatively up to 6 weight percent, or alternatively up to 5 weight percent, based on the total weight of the composition. In some embodiments, the amount of water soluble silicate is from 4 to 6 weight percent, alternatively it is 5 weight percent, based on the total weight of the composition.

The dispersant polymer of the composition of the invention comprises a (meth)acrylic polymer with a Mw from 2000 to 100,000. In some embodiments, the polymer has a Mw of at least 3,000, preferably at least 4,000; and preferably no more than 70,000, preferably no more than 50,000, preferably no more than 30,000, preferably no more than 25,000, preferably no more than 20,000, preferably no more than 10,000, and preferably no more than 6,000. In some embodiments, the dispersant polymer has a molecular weight ranging from 1,000 to 40,000. In some embodiments, the dispersant polymer has a molecular weight ranging from 14,000 to 18,000.

In some embodiments, the dispersant polymer comprises a homopolymer of (meth)acrylic acid, a copolymer of methacrylic acid and acrylic acid, a copolymer of (meth)acrylic acid with one or more other ethylenically unsaturated monomers, salts thereof, or mixtures thereof.

In some embodiments, suitable other ethylenically unsaturated monomers for inclusion in the dispersant polymer may include one or more of esters of acrylic or (meth)acrylic acid (e.g., ethyl acrylate, butyl acrylate), styrene monomers (e.g., styrene), sulfonated monomers (e.g., 2-acrylamido-2-methylpropane sulfonic acid (AMPS), 2-(meth)acrylamido-2-methylpropane sulfonic acid, 4-styrenesulfonic acid, vinylsulfonic acid, 3-allyloxy, 2-hydroxy 1-propane sulfonic acid (HAPS), 2-sulfoethyl(meth)acrylic acid, 2-sulfopropyl(meth)acrylic acid, 3-sulfopropyl(meth) acrylic acid, and 4-sulfobutyl(meth)acrylic acid, a salt thereof), substituted (meth)acrylamides (e.g., tert-butyl acrylamide), or salts thereof.

In some embodiments, the dispersant polymer comprises a copolymer derived from polymerized units of 50 to 95 weight percent (preferably 70 to 93 weight percent) acrylic acid and from 5 to 50 weight percent (preferably 7 to 30 weight percent) 2-acrylamido-2-methylpropane sulfonic acid sodium salt, preferably with a Mw from 2,000 to 40,000, more preferably from 10,000 to 20.000.

In some embodiments, the dispersant polymer comprises a homopolymer of acrylic acid, preferably with a Mw from 2,000 to 40,000, more preferably from 2,000 to 10,000.

In some embodiments, the dispersant polymer comprises a mixture of a homopolymer of acrylic acid and a copolymer derived from polymerized units of acrylic acid and 2-acrylamido-2-methylpropane sulfonic acid sodium salt.

In some embodiments, the composition of the invention contains at least 1 weight percent, alternatively at least 2 weight percent, alternatively at least 3 weight percent, or alternatively at least 5 weight percent of the polymer, based on the total weight of the composition. In some embodiments, the amount of polymer is up to 10 weight percent, alternatively up to 8 weight percent, alternatively up to 6 weight percent, or alternatively up to 4 weight percent, based on the total weight of the composition.

In some embodiments, when a water soluble silicate is present in the composition, the weight ratio of the aspartic acid diacetic acid or salt thereof to the water soluble silicate is from 5:1 to 1:5, alternatively, from 5:1 to 1:2, or alternatively, from 5:1 to 1:1. In some embodiments, the weight ratio is 5:1. In some embodiments, the weight ratio is 1:1. In some embodiments, the weight ratio 1:1.2.

Dispersant polymers for use in the invention are commercially available from various sources, and/or they may be prepared using literature techniques. For instance, low-molecular weight dispersant polymers may be prepared by free-radical polymerization. A preferred method for preparing these polymers is by homogeneous polymerization in a solvent. The solvent may be water or an alcoholic solvent such as 2-propanol or 1,2-propanediol. The free-radical polymerization is initiated by the decomposition of precursor compounds such as alkali persulfates or organic peracids and peresters. The activation of these precursors may be by the action of elevated reaction temperature alone (thermal activation) or by the admixture of redox-active agents such as a combination of iron(II) sulfate and ascorbic acid (redox activation). In these cases, a chain-transfer agent is typically used to modulate polymer molecular weight. One class of preferred chain-transfer agents employed in solution polymerizations is the alkali or ammonium bisulfites. Specifically mentioned is sodium meta-bisulfite.

The dispersant polymer may be in the form of a water-soluble solution polymer, slurry, dried powder, or granules or other solid forms.

The builder for use in the composition of the invention is preferably one or more carbonates or citrates. The term "carbonate(s)" refers to alkali metal or ammonium salts of carbonate, bicarbonate, percarbonate, and/or sesquicarbonate. The term "citrate(s)" refers to alkali metal citrates. Preferably, the carbonates or citrates are sodium, potassium or lithium salts; preferably sodium or potassium; preferably sodium. Preferred builders include sodium carbonate, sodium bicarbonate, sodium citrate, or mixtures of two or more thereof.

In some embodiments, the composition contains at least 1 weight percent, alternatively at least 10 weight percent, alternatively at least 20 weight percent, or alternatively at least 25 weight percent of the builder, based on the total weight of the composition. In some embodiments, the composition contains up to 60 weight percent, alternatively up to 50 weight percent, alternatively up to 40 weight percent, or alternatively up to 35 weight percent of the builder based on the total weight of the composition. Weight percentages of carbonates or citrates are based on the actual weights of the salts, including metal ions.

The composition of the invention contains one or more surfactants. The surfactant may be anionic, cationic, or nonionic. Preferred are nonionic surfactants, more preferably low foam nonionic surfactants. Exemplary nonionic surfactants include, without limitation, alkoxylate surfactants, particularly those based on ethylene oxide, propylene oxide, and/or butylene oxide. Examples include compounds having the formula RO-(M)x-(N)n-OH or R—O-(M)x-(N)y-O—R' in which M and N are units derived from alkylene oxides (of which one is ethylene oxide), x and y are integers from 0 to 20, provided at least one of them is not zero, R represents a C6-C22 linear or branched alkyl group, and R' represents a group derived from the reaction of an alcohol precursor with a C6-C22 linear or branched alkyl halide, epoxyalkane, or glycidyl ether. Other suitable nonionic surfactants include, without limitation, polyether polyols.

In some embodiments, the composition may contain at least 0.5 weight percent, alternatively at least 1 weight percent, alternatively at least 2 weight percent of the surfactant, based on the total weight of the composition. In some embodiments, the composition may up to 10 weight percent, alternatively up to 6 weight percent, or alternatively up to 3 weight percent of the surfactant, based on the total weight of the composition.

The composition may contain other optional components, for instance, one or more of: an alkaline source, a bleaching agent (e.g., sodium percarbonate, sodium perborate) and optionally a bleach activator (e.g., tetraacetylethylenediamine (TAED)) and/or a bleach catalyst (e.g., manganese(II) acetate, or cobalt(II) chloride); an enzyme (e.g., protease, amylase, lipase, or cellulase); an aminocarboxylate compound (e.g., MGDA); foam suppressants; colors; fragrances; additional builders; antibacterial agents and/or fillers. Fillers in tablets or powders are inert, water-soluble substances, typically sodium or potassium salts, e.g., sodium or potassium sulfate and/or chloride, and typically are present in amounts ranging from 0 wt % to 75 wt %. Fillers in gel formulations may include those mentioned above and also water. Fragrances, dyes, foam suppressants, enzymes and antibacterial agents usually total no more than 10 wt %, alternatively no more than 5 wt %, of the composition.

As indicated, the composition may contain an alkaline source. Suitable alkaline sources include, without limitation, alkali metal carbonates and alkali metal hydroxides, such as sodium or potassium carbonate, bicarbonate, sesquicarbonate, sodium, lithium, or potassium hydroxide, or mixtures of the foregoing. Sodium hydroxide is preferred. The amount of alkaline source, when present, may range, for instance, from at least 1 weight percent, alternatively at least 20 weight percent, and up to 80 weight percent, or alternatively up to 60 weight percent, based on the total weight of the composition.

As indicated, the composition may contain a bleaching agent as an optional component. When present, the bleaching agent is preferably at a concentration of at least 5 weight percent, and up to 25 weight percent, based on the total weight of the composition. If a bleaching activator is used, a suitable concentration is, for instance, from 1 to 10 weight percent, based on the total weight of the composition.

In some embodiments, the composition of the invention comprises: sodium carbonate, a bleaching agent (preferably sodium percarbonate), a bleaching activator (preferably TAED), a nonionic surfactant (preferably an alkoxylate surfactant, a polyether polyol, or both), an enzyme (preferably protease, amylase, or both), a dispersant polymer (preferably a homopolymer of acrylic acid, a copolymer of acrylic acid and AMPS (or a salt of AMPS), or mixtures of the polymers), and optionally a water soluble silicate (preferably sodium disilicate).

In some embodiments, the composition of the invention comprises: 15 to 50 weight percent sodium carbonate, 5 to 15 weight percent of a bleaching agent (preferably sodium percarbonate), 1 to 5 weight percent of a bleaching activator (preferably TAED), 0.5 to 5 weight percent of a nonionic surfactant (preferably an alkoxylate surfactant, a polyether polyol, or both), 1 to 5 weight percent of an enzyme (preferably protease, amylase, or both), 1 to 10 weight percent of a dispersant polymer (preferably a homopolymer of acrylic acid, a copolymer of acrylic acid and AMPS (or a salt of AMPS), or mixtures of the polymers), and 1 to 10 weight percent of a water soluble silicate (preferably sodium disilicate), each amount being based on the total weight of the composition.

Preferably, the composition has a pH (at 1 wt % in water) of at least 10, preferably at least 11.5; in some embodiments the pH is no greater than 13.

The composition can be formulated in any typical form, e.g., as a tablet, powder, block, monodose, sachet, paste, liquid or gel. The compositions are useful for cleaning ware, such as eating and cooking utensils, dishes, in an automatic dishwashing machine. They may also be used for cleaning other hard surfaces, such as showers, sinks, toilets, bathtubs, countertops, and the like.

The composition can be used under typical operating conditions. For instance, when used in an automatic dishwashing machine, typical water temperatures during the washing process preferably are from 20° C. to 85° C., preferably 30° C. to 70° C. Typical concentrations for the composition as a percentage of total liquid in the dishwasher preferably are from 0.1 to 1 wt %, preferably from 0.2 to 0.7 wt %. With selection of an appropriate product form and addition time, the composition may be present in the prewash, main wash, penultimate rinse, final rinse, or any combination of these cycles.

In some embodiments, the composition of the invention is phosphate free. The term "phosphorus-free" refers to compositions containing less than 0.5 wt % phosphorus (as elemental phosphorus), preferably less than 0.2 wt %, preferably less than 0.1 wt %, preferably no detectable phosphorus.

Some embodiments of the invention will now be described in detail in the following Examples.

EXAMPLES

Synthesis of Example Dispersant Polymers.

Dispersant Polymer 1. A copolymer based on 72 wt % acrylic acid and 28 wt % 2-acrylamido-2-methylpropane sulfonic acid sodium salt, with a Mw of 14000 to 18000. The polymer may be prepared by a person of ordinary skill in the art using known methods. A typical procedure is as follows.

To a two liter round bottom flask, equipped with a mechanical stirrer, heating mantle, thermocouple, condenser and inlets for the addition of monomer, initiator and chain regulator is charged 253 grams deionized water. The mixture is set to stir and heated to 72° C. (+/−2° C.). In the meantime, a monomer solution of 209.7 grams glacial acrylic acid and 180.5 grams of 50% solution of sodium AMPS is added to a graduated cylinder, thoroughly mixed for addition to the flask. An initiator solution of 2.1 grams sodium persulfate is dissolved in 20 grams deionized water and added to a syringe for addition to the kettle. A chain regulator solution of 6.7 grams sodium metabisulfite dissolved in 27 grams deionized water is added to a syringe for addition to the kettle. A promoter solution of 0.6 grams of a 0.15% iron sulfate heptahydrate solution is added to a vial and set aside.

Once the kettle contents reach reaction temperature of 72° C., the promoter solution is added. The sodium bisulfite solution cofeed is begun, adding to the kettle over 105 minutes. After 3 minutes, the monomer and initiator cofeeds are started. The monomer feed is added over 110 minutes and initiator cofeed added over 112 minutes at 72° C.

At the completion of the feeds, 17 grams deionized water is added to the monomer feed vessel, as rinse. The reaction is held for 5 minutes at 72° C. In the meantime, the chaser solution 0.5 grams sodium persulfate and 10 grams deionized water are mixed and set aside.

At the completion of the hold, the above solution is added linearly over 5 minutes and held for 15 minutes at 72° C. The chaser solution preps are repeated and added to the kettle over 5 minutes, followed by a 5 minute hold.

At the completion of the final hold, 24.5 grams of deionized water is added to the kettle with cooling. At 50° C. or below a solution of 100 grams of 50% sodium hydroxide is added to an addition funnel and slowly added to the kettle, controlling the exotherm to keep the temperature below 70° C. The funnel is then rinsed with 10 grams deionized water. Finally, 1.5 grams of a scavenger solution of 35% hydrogen peroxide are added to the kettle. The reaction is then cooled and packaged.

Dispersant Polymer 2. A homopolymer of acrylic acid with a Mw of approximately 2000. The polymer may be prepared by a person skilled in the art substantially as described above with appropriate reagent modifications.

Polymer Molecular Weight. Molecular weight may be measured by gel permeation chromatograph (GPC) using known methodology, for instance with the following typical parameters:

Analytical Parameters:

Instrument: Agilent 1100 HPLC system with isocratic pump, vacuum degasser, variable injection size autosampler, and column heater, or equivalent.

Detector: Agilent 1100 HPLC G1362A Refractive Index detector, or equivalent.

Software: Agilent ChemStation, version B.04.03 with Agilent GPC-Addon version B.01.01.

Column Set: TOSOH Bioscience TSKgel G2500PWxl 7.8 mm ID×30 cm, 7 μm column (P/N 08020) with TOSOH Bioscience TSKgel GMPWxl 7.8 mm ID×30 cm, 13 μm (P/N 08025).

Method Parameters:

Mobile Phase: 20 mM Phosphate buffer in MilliQ HPLC Water, pH~7.0.

Flow Rate: 1.0 ml/minute.

Injection volume: 20 μL.

Column temperature: 35° C.

Run time: 30 minutes.

Standards and Samples:

Standards: Polyacrylic acid, Na salts Mp 216 to Mp 1,100,000. Mp 900 to Mp 1,100,000 standards from American Polymer Standards.

Calibration: Polynomial fit using Agilent GPC-Addon software (Polynomial 4 used).

Injection concentration: 1-2 mg solids/mL 20 mM GPC mobile phase diluent. Used for both standards and samples.

Sample concentration: Typically, 10 mg sample into 5 mL 20 mM AQGPC mobile phase solution.

Flow Marker: 30 mM phosphate.

Solutions Preparation:

Mobile Phase: Mobile Phase: Weigh out 14.52 g sodium phosphate monobasic ($NaH_2PO_4$) and 14.08 g sodium phosphate dibasic ($Na_2HPO_4$).

Dissolve into 11 L MilliQ HPLC water, stir to fully dissolve all solids.

After they're dissolved and mixed in, adjusted the solution to pH 7 with 0.5 N sodium hydroxide. This solution is used for mobile phase and sample/standard preparation via a fixed volume repipetor.

Flow Marker: Mix, by weight, equal amounts of solid $Na_2HPO_4$ and $NaH_2PO_4$. Using the well-blended mix, weigh 1.3 grams and dissolve into 1 liter of the 20 mM AQGPC mobile phase mix.

Example 1. Cleaning Performance

TABLE 1

| | Formulation | | | |
|---|---|---|---|---|
| | 1 Wt. % | 2 Wt. % | 3 Wt. % | 4 Wt. % |
| Sodium Carbonate (Builder) | 30 | 30 | 30 | 30 |
| Sodium Percarbonate (Bleach) | 10 | 10 | 10 | 10 |
| TAED (Bleach Activator) | 2.5 | 2.5 | 2.5 | 2.5 |
| Surfactant | 2 | 2 | 2 | 2 |
| Enzyme | 3 | 3 | 0 | 0 |
| Dispersant Polymer 1 | 2 | 2 | 2 | 2 |
| Dispersant Polymer 2 | 1 | 1 | 1 | 1 |
| Aminocarboxylate (selected from MGDA, ASDA, GLDA) | 15 | 15 | 15 | 15 |
| Sodium Disilicate | 5 | 1 | 5 | 1 |
| Sodium sulfate | balance | balance | balance | balance |

Conditions for Dishwashing Tests:

Machine: Kenmore SS-ADW, Model 15693

Wash program: Normal wash cycle with heated wash, fuzzy logic engaged, heated dry Cycle time: ca. 2 h Water hardness: 300 ppm as $CaCO_3$ (confirmed by EDTA Titration)

Ca:Mg (molar): 2:1

Tank water T, ° C.: 54

ADW basin initial T, ° C.: 43

Total detergent weight, g 20

Food soil: STIWA (50 g per cycle)

Example 1A. Detergent Testing without Food Soil

In this example, detergent formulations are tested in the absence of food soil. The example therefore examines deposition of inorganic scale. Formulations 3 and 4 (Table 1), containing MDGA, ADSA, or GLDA are tested in this example. Because food soil is not present, the formulations 3 and 4 are free of added enzymes. The powdered components are premixed, and added to the dishwasher alongside the liquid components to prevent pre-reaction of incompatible materials.

Filming performance is rated according to the rating system in Table 2 by two trained observers (see ASTM D 3556-85).

TABLE 2

| Rating System for Cleaning | | |
|---|---|---|
| Score | Filming | Spotting |
| 1 | No Film | No Spots |
| 1.5 | Barely Perceptible | Trace |
| 2 | Slight | Random |
| 3 | Intermediate | ¼ Glass |

TABLE 2-continued

| Rating System for Cleaning | | |
|---|---|---|
| Score | Filming | Spotting |
| 4 | Moderate | ½ Glass |
| 5 | Heavy | Complete |

Observed film rating results are shown in Table 3.

TABLE 3

Average Observed Film Rating on Glasses, Without Food Soil (Ratings: 1-5):

| Description: | Formulation 3 (5 wt % silicate) | | | Formulation 4 (1 wt % silicate) | | |
|---|---|---|---|---|---|---|
| | MGDA[1] | ASDA[2] | GLDA[1] | MGDA[1] | ASDA[2] | GLDA[1] |
| Stripped[3] | 1.0 | 1.0 | 1.0 | 1.0 | 1.0 | 1.0 |
| 1st Cycle | 2.8 | 2.6 | 3.4 | 2.2 | 3.2 | 2.1 |
| 3rd Cycle | 2.2 | 2.0 | 2.6 | 2.9 | 3.1 | 3.1 |
| 5th Cycle | 1.9 | 1.8 | 2.4 | 2.7 | 2.4 | 2.5 |
| 10th Cycle | 1.9 | 1.7 | 2.2 | 2.2 | 1.8 | 2.4 |
| St. Dev. Stripped | 0 | 0 | 0 | 0 | 0 | 0 |
| St. Dev. 1st Cycle | 0.28 | 0.28 | 0.21 | 0.07 | 0.00 | 0.14 |
| St. Dev. 3d Cycle | 0.07 | 0.28 | 0.28 | 0.78 | 0.14 | 0.99 |
| St. Dev. 5th Cycle | 0.07 | 0.00 | 0.28 | 0.14 | 0.21 | 0.00 |
| St. Dev. 10th Cycle | 0.10 | 0.05 | 0.24 | 0.10 | 0.14 | 0.10 |

[1]comparative example;
[2]inventive example;
[3]dishwasher and dishware are thoroughly cleaned prior to formulation testing The results in Table 3 demonstrate that in the run with 5% disilicate, ASDA exhibits better filming performance than MGDA and GLDA.

Example 1B. Testing with Food Soil

Food Soil. A STIWA food soil sample used in this example is shown in Table 4 ("STIWA" is a standard food soil set by the testing group Stiftung Warentest).

TABLE 4

Food Soils

| Name Source | "STIWA" Amount |
|---|---|
| Margarine | 100 g |
| Gravy Powder | 25 g |
| Potato Starch | 5 g |
| Benzoic Acid | 1 g |
| Egg Yolk | 3 g |
| Mustard | 25 g |
| Ketchup | 25 g |
| Milk | 50 g |
| Tap Water | 700 g |

Protocol for preparation of STIWA food soil: 1. Bring water to a boil; 2. Mix in 16 oz paper cup: instant gravy, benzoic acid and starch; add this mixture to the boiling water; 3. Add milk and margarine; 4. Let the mixture cool down to approximately 40° C.; 5. Fill the mixture into a bowl of Kitchen Machine (polytron); 6. In a 16 oz paper cup, mix the egg yolk, ketchup and mustard using a spoon; 7. Add the cool down mixture to the bowl stirring continuously; 8. Let the mixture stir for 5 min; 9. Freeze the mixture; 10. The frozen slush is placed into the dishwasher at the time indicated below.

Sample detergent formulations for testing in the examples are shown in Table 1 (formulations 1 and 2). The powdered components are premixed, and added to the dishwasher alongside the liquid components to prevent pre-reaction of incompatible materials.

Food soil is charged when the detergent is charged to the wash liquor (20 min mark). After drying in open air, two glasses are rated according to the above rating system on both fouling and spotting. Results are shown in Table 5 (film rating) and Table 6 (spotting).

TABLE 5

Average Observed Film Rating on Glasses, with STIWA Food Soil (Ratings: 1-5):

| Description: | Formulation 1 (5 wt % silicate) | | | Formulation 2 (1 wt % silicate) | | |
|---|---|---|---|---|---|---|
| | MGDA[1] | ASDA[2] | GLDA[1] | MGDA[1] | ASDA[2] | GLDA[1] |
| Stripped[3] | 1.0 | 1.0 | 1.0 | 1.0 | 1.0 | 1.0 |
| 1st Cycle | 2.1 | 2.1 | 2.9 | 1.8 | 2.4 | 2.2 |
| 3rd Cycle | 1.6 | 1.6 | 2.1 | 1.8 | 2.1 | 2.1 |
| 5th Cycle | 2.6 | 2.0 | 2.3 | 1.7 | 2.4 | 1.8 |
| 10th Cycle | 2.8 | 2.1 | 1.8 | 1.7 | 1.8 | 1.7 |
| St. Dev. Stripped | 0 | 0 | 0 | 0 | 0 | 0 |
| St. Dev. 1st Cycle | 0.14 | 0.07 | 0.14 | 0.35 | 0.28 | 0.28 |
| St. Dev. 3d Cycle | 0.14 | 0.42 | 0.57 | 0.35 | 0.42 | 0.28 |
| St. Dev. 5th Cycle | 0.49 | 0.42 | 0.42 | 0.21 | 0.21 | 0.00 |
| St. Dev. 10th Cycle | 0.36 | 0.29 | 0.22 | 0.23 | 0.47 | 0.17 |

[1]comparative example;
[2]inventive example.

TABLE 6

Average Observed Spotting Rating on Glasses, with STIWA Food Soil (Ratings: 1-5):

| Description: | Formulation 1 (5 wt % silicate) | | | Formulation 2 (1 wt % silicate) | | |
|---|---|---|---|---|---|---|
| | MGDA[1] | ASDA[2] | GLDA[1] | MGDA[1] | ASDA[2] | GLDA[1] |
| Stripped | 1.0 | 1.0 | 1.0 | 1.0 | 1.0 | 1.0 |
| 1st Cycle | 1.8 | 1.5 | 1.5 | 2.0 | 1.6 | 2.4 |
| 3rd Cycle | 2.0 | 1.6 | 1.6 | 2.4 | 1.6 | 1.9 |
| 5th Cycle | 2.8 | 2.8 | 1.8 | 2.4 | 2.7 | 2.1 |
| 10th Cycle | 1.5 | 1.7 | 2.2 | 1.9 | 2.1 | 2.0 |
| St. Dev. Stripped | 0 | 0 | 0 | 0 | 0 | 0 |
| St. Dev. 1st Cycle | 0.28 | 0.00 | 0.00 | 0.71 | 0.14 | 0.85 |
| St. Dev. 3d Cycle | 0.00 | 0.07 | 0.07 | 0.85 | 0.07 | 0.14 |
| St. Dev. 5th Cycle | 0.35 | 0.35 | 0.28 | 0.92 | 0.21 | 0.57 |
| St. Dev. 10th Cycle | 0.33 | 0.24 | 0.24 | 0.24 | 0.48 | 0.34 |

[1]comparative example;
[2]inventive example

Silverware present in the dishwasher during the above runs are observed. In the run with 5% disilicate, ASDA and GLDA exhibit better filming performance than MGDA, and ASDA and MGDA exhibit better spotting performance than GLDA. In the run with 1% disilicate, ASDA, MGDA and GLDA were relatively equivalent.

Several spots on knives exposed to the MGDA based formulation show significant brown discoloration when compared to ASDA containing formulations. This is recorded as a visual observation during testing.

Example 2. Cleaning Performance Under Harsh Conditions

In this example, performance is tested under cleaning conditions that are typically used in Western Europe, which are generally harsher than conditions in the United States, in terms of the water hardness. In addition, the challenge of the test is further increased through greater use of egg yolk in the food soil composition (egg yolk is highly spotting). Test conditions for this example are as follows.

Conditions for Dishwashing Test

Machine: Miele G 1222 SCL

Wash program: Build up test: Prewash, Wash at 65° C. with holding time 30 min at 65° C.

Rinse performance test: wash at 50° C. with holding time 8 min at 50° C.

Water hardness: 37 fH (370 ppm)

Ca:Mg (molar): 3:1

Total detergent weight: 20 g per cycle added at the beginning of the main wash

Food soil: 50 g per cycle added at the beginning of the main wash

Food Soil Preparation

TABLE 7

| Ingredients | |
|---|---|
| water | 700 g |
| Potato starch | 5 g |
| Instant powder | 25 g |
| Benzoic acid | 1 g |
| Margarine | 100 g |
| Milk | 50 g |
| egg yolk | 54 g |
| Ketchup | 25 g |
| Mustard | 25 g |

The water is heated to 70° C. Potato starch, instant powder, benzoic acid, melted margarine and milk are added to the water and mixed. When the temperature reaches 45° C., egg yolk, ketchup and mustard are added. The preparation is well mixed and stored in the freezer.

Formulation

Formulations tested are shown in Table 8. All powder ingredients are mixed together and added at the same time as the liquid components to the machine for each cycle.

TABLE 8

| Description | Formula A | Formula B | Formula C | Formula D |
|---|---|---|---|---|
| Aminocarboxylate (selected from MGDA, ASDA, GLDA) | 30% | 15% | 30% | 15% |
| Sodium citrate | 0% | 15% | 0% | 15% |
| Sodium Carbonate | 20% | 20% | 20% | 20% |
| Sodium Bicarbonate | 10% | 10% | 10% | 10% |
| Disilicate (water soluble silicate) | 0% | 0% | 2% | 2% |
| Percarbonate | 15% | 15% | 15% | 15% |
| TAED | 4% | 4% | 4% | 4% |
| Surfactant | 5% | 5% | 5% | 5% |
| Dispersant Polymer 1 | 2.5% | 2.5% | 2.5% | 2.5% |
| Dispersant Polymer 2 | 2.5% | 2.5% | 2.5% | 2.5% |
| Protease | 2% | 2% | 2% | 2% |
| Amylase | 1% | 1% | 1% | 1% |
| HEDP | 2% | 2% | 2% | 2% |
| Sodium Sulfate (Filler) | 6% | 6% | 6% | 6% |

HEDP = 1-hydroxyl ethylidene-1,1,-diphosphonic acid (a crystal growth inhibitor, sometimes used in European ADW formulations)

Results

After drying in open air, glasses are rated from 1 (clean) to 5 (heavily fouled) on both fouling and spotting by trained observers (see above for more details on the rating system). Results are shown in the following tables. Formulations containing ASDA are inventive. Formulations containing MGDA or GLDA, without ASDA, are comparative.

Build Up Test

TABLE 9

| | Formula A MGDA | Formula A ASDA | Formula B MGDA | Formula B ASDA |
|---|---|---|---|---|
| film cycle 6 | 1.75 | 2 | 1.5 | 1.25 |
| film cycle 10 | 2.5 | 2.75 | 2 | 2.5 |
| film cycle 20 | 2.5 | 2.75 | 2.5 | 2.5 |
| film cycle 30 | 3 | 3.5 | 3 | 3.5 |

TABLE 10

| | Formula A MGDA | Formula A ASDA | Formula B MGDA | Formula B ASDA |
|---|---|---|---|---|
| spot cycle 6 | 4 | 4 | 4 | 4.5 |
| spot cycle 10 | 4 | 4 | 4 | 4 |
| spot cycle 20 | 3 | 3 | 4 | 4 |
| spot cycle 30 | 1 | 1 | 4 | 4 |

TABLE 11

| | Formula C MGDA | Formula C ASDA | Formula C GLDA | Formula D MGDA | Formula D ASDA | Formula D GLDA |
|---|---|---|---|---|---|---|
| film cycle 6 | 2 | 2 | 2 | 2 | 2 | 2 |
| film cycle 10 | 2 | 2 | 2 | 2.5 | 2 | 2.5 |
| film cycle 20 | 3 | 3 | 3 | 3.5 | 3.5 | 3.5 |
| film cycle 30 | 3 | 3 | 3.5 | 3.5 | 3.5 | 3.5 |

TABLE 12

| | Formula C MGDA | Formula C ASDA | Formula C GLDA | Formula D MGDA | Formula D ASDA | Formula D GLDA |
|---|---|---|---|---|---|---|
| spot cycle 6 | 1 | 1 | 1 | 1 | 1 | 1 |
| spot cycle 10 | 3.5 | 1 | 1 | 3.5 | 1 | 1 |
| spot cycle 20 | 1 | 1 | 1 | 1 | 1 | 1 |
| spot cycle 30 | 1 | 1 | 1 | 1 | 1 | 1 |

Rinse Performance Test

TABLE 13

| | Formula C MGDA | Formula C ASDA | Formula C GLDA | Formula D MGDA | Formula D ASDA | Formula D GLDA |
|---|---|---|---|---|---|---|
| film cycle 1 | 1 | 1 | 1 | 1 | 1 | 1 |
| film cycle 3 | 1.25 | 1.25 | 1.5 | 2 | 1.75 | 1.5 |
| film cycle 5 | 1.5 | 1.5 | 1.5 | 2 | 1.5 | 1.5 |

TABLE 14

| | Formula C MGDA | Formula C ASDA | Formula C GLDA | Formula D MGDA | Formula D ASDA | Formula D GLDA |
|---|---|---|---|---|---|---|
| spot cycle 1 | 5 | 5 | 4 | 4 | 4 | 4 |
| spot cycle 3 | 5 | 5 | 3.5 | 4 | 4 | 4 |
| spot cycle 5 | 4 | 4 | 4 | 5 | 5 | 5 |

Example 3. Corrosion Resistance

In this example, the corrosion resistance of stainless steel to automatic dishwashing detergents (ADW) containing ASDA, is compared to formulations MGDA or GLDA (and no ASDA).

Nine different samples are tested in this Example. Samples 3-1 to 3-6 (Table 15) are detergent compositions that correspond to formulations 1 and 2 in Table 1, with appropriate selection of the aminocaboxylate compound. Samples 3-7 to 3-9 are mixtures of the aminocarboxylate with water (with no other detergent ingredients). The amount of active ingredient in samples 3-7 to 3-9 corresponds to the amount used in samples 3-1 to 3-6. Further details on the samples are shown in Table 15.

TABLE 15

Test Materials

| Test material ID # | Active Ingredient under test | Water soluble silicate Concentration | Sample State as Received |
|---|---|---|---|
| 3-1 | MGDA | 5% Silicate | Solid |
| 3-2 | ASDA | 5% Silicate | Solid |
| 3-3 | GLDA | 5% Silicate | Solid |
| 3-4 | MGDA | 1% Silicate | Solid |
| 3-5 | ASDA | 1% Silicate | Solid |
| 3-6 | GLDA | 1% Silicate | Solid |
| 3-7 | MGDA | none | Liquid |
| 3-8 | ASDA | none | Liquid |
| 3-9 | GLDA | none | Liquid |

For the solid samples, 20 grams of the solid is dissolved in 4 liters of tap water to mimic the dilution used in the United States. Approximately 1500 g of the final solution is used for each test. For the liquid samples, 1% solutions based on the active ingredient (the aminocaboxylate) in tap water are prepared. Nominally, 15 g of each sample is added to 1500 g of tap water.

Immersion Tests

Corrosion testing is performed on stainless steel SS430 test coupons and test coupons prepared from representative commercial Oneida brand stainless steel cutlery. The tests are conducted substantially in accordance with ASTM Designation: G 31-72 ("Standard Practice for Laboratory Immersion Corrosion Testing of Metals"), ASTM Designation: G 1-03 ("Standard Practice for Preparing, Cleaning, and Evaluating Corrosion Test Specimens"), and NACE Standard TM-01-69 ("Test Method—Laboratory Corrosion Testing of Metals for the Process Industries").

In summary, partial immersion coupons are suspended by Teflon tap within a 2 liter glass resin jar filled with 1500 g of an ADW solution. All alloys are tested in triplicate. A magnetic stir bar is introduced into each flask with moderate agitation provided by a magnetic stirrer. A 55° C. solution temperature is maintained using a heating mantel and temperature controller. All resin jars are fitted with a water cooled reflux condenser to maintain solution level throughout the one week test period. Testing is performed in three rounds each consisting of three, one week, tests.

After completion of testing, the coupons are removed from the test solutions, photographed, cleaned and weighed. The coupons are visually examined using a variable stereo zoom microscope for localized corrosion. Observations are summarized in Table 16.

TABLE 16

Test Results Based on Visual Observation of the Stainless Steel Test Coupons

| Test material ID # | Active Ingredient under test | Visual Observations |
|---|---|---|
| 3-1 | MGDA | Surface staining at the vapor/liquid interface, vapor phase pitting; rust deposits noted |
| 3-2 | ASDA | Surface staining at the vapor/liquid interface. No visible signs of corrosion |
| 3-3 | GLDA | Surface staining at the vapor/liquid interface. No visible signs of corrosion |
| 3-4 | MGDA | Surface staining at the vapor/liquid interface. No visible signs of corrosion |
| 3-5 | ASDA | Surface staining at the vapor/liquid interface. No visible signs of corrosion |
| 3-6 | GLDA | Surface staining at the vapor/liquid interface. No visible signs of corrosion |
| 3-7 | MGDA | Surface staining at the vapor/liquid interface. No visible signs of corrosion |
| 3-8 | ASDA | Surface staining at the vapor/liquid interface. No visible signs of corrosion |
| 3-9 | GLDA | Surface staining at the vapor/liquid interface. No visible signs of corrosion |

Testing shows localized pitting corrosion of alloy SS430 exposed to an MGDA formulation under the conditions tested. Since pitting is probabilistic in nature it is not unexpected that not all the coupons exposed to the MGDA 5% silicate formulation would show localized pitting attack. It is generally accepted among the corrosion community, however, that any evidence of localized pitting during lab testing or in the field is cause for concern.

Alloy SS430 exposed to the ASDA and GLDA formulations show no visible signs of localized pitting corrosion. Coupons prepared from the Oneida brand knives exposed to all test formulations show no visible evidence of localized pitting corrosion.

The data suggests, that under the conditions tested, stainless steel exposed to an ADW formulation containing MGDA has a greater susceptibility to localized pitting corrosion then when exposed to a formulation containing ASDA, particularly when the MGDA is formulated as a detergent (e.g., sample 3-1). This suggests that the corrosion effect of MGDA is not necessarily inherent the in the material, but rather occurs when it is formulated.

The data also indicates that under the conditions tested, the corrosion performance of ADW formulations containing ASDA or GLDA is comparable, and less than MGDA.

Although corrosion resistance between the inventive ASDA versus the comparative GLDA is similar, the ASDA formulations exhibit better cleaning performance than the GLDA formulations, as demonstrated in Example 2. This, together with the corrosion data of Example 3, shows that a detergent formulated specifically with ASDA will show overall better performance when both cleaning and corrosion resistance are considered.

What is claimed is:

1. An automatic dishwashing detergent composition comprising:

aspartic acid diacetic acid or salt thereof;

a builder; and a surfactant;

a dispersant polymer with a Mw from 2000 to 100,000, wherein the dispersant polymer is selected from the group consisting of a homopolymer of (meth)acrylic acid, a copolymer consisting of methacrylic acid and acrylic acid, a copolymer consisting of (meth)acrylic acid and at least one ethylenically unsaturated monomer, salts thereof and mixtures thereof;

wherein the at least one ethylenically unsaturated monomer is selected from the group consisting of ethyl acrylate, butyl acrylate, styrene, 2-acrylamido-2-methylpropane sulfonic acid, 2-(meth)acrylamido-2-methylpropane sulfonic acid, 4-styrenesulfonic acid, vinylsulfonic acid, 3-allyloxy-2-hydroxy-1-propane sulfonic acid, 2-sulfoethyl(meth)acrylic acid, 2-sulfopropyl (meth)acrylic acid, 3-sulfopropyl(meth)acrylic acid, 4-sulfobutyl(meth)acrylic acid, salts thereof and mixtures thereof.

2. The composition of claim 1, further comprising a water soluble silicate.

3. The composition of claim 1, wherein the dispersant polymer consists of a copolymer consisting of polymerized units of 50 to 95 weight percent acrylic acid and from 5 to 50 weight percent 2-acrylamido-2-methylpropane sulfonic acid sodium salt.

4. The composition of claim 1, wherein the dispersant polymer consists of a homopolymer derived from polymerized units of acrylic acid.

5. The composition of claim 1, comprising from:

from 10 to 40 weight percent of the aspartic acid diacetic acid or salt thereof;

from 0.1 to 10 weight percent of the water soluble silicate;

from 1 to 10 weight percent of the dispersant polymer;

from 1 to 60 weight percent of the builder; and from 1 to 10 weight percent of the surfactant, each based on the total weight of the composition.

6. The composition of claim 1, further comprising one or more of: a bleaching agent, a bleach activator, a bleach catalyst, an enzyme and an aminocarboxylate compound.

7. The composition of claim 1, in which the composition contains less than 0.2 weight percent phosphorus.

8. A method of cleaning an article in an automatic dishwashing machine, the method comprising: applying to the article the composition of claim 1.

* * * * *